US011910909B2

(12) United States Patent
Delbove

(10) Patent No.: US 11,910,909 B2
(45) Date of Patent: Feb. 27, 2024

(54) DEVICE FOR SUPPORTING A COSMETIC ARTICLE

(71) Applicant: L'OREAL, Paris (FR)

(72) Inventor: William Delbove, Clichy (FR)

(73) Assignee: L'OREAL, Paris (FR)

( * ) Notice: Subject to any disclaimer, the term of this patent is extended or adjusted under 35 U.S.C. 154(b) by 864 days.

(21) Appl. No.: 16/964,888

(22) PCT Filed: Jan. 25, 2019

(86) PCT No.: PCT/EP2019/051909
§ 371 (c)(1),
(2) Date: Jul. 24, 2020

(87) PCT Pub. No.: WO2019/145510
PCT Pub. Date: Aug. 1, 2019

(65) Prior Publication Data

US 2021/0030137 A1 Feb. 4, 2021

(30) Foreign Application Priority Data

Jan. 29, 2018 (FR) ..... 18 50662

(51) Int. Cl.
*A45D 40/10* (2006.01)

(52) U.S. Cl.
CPC ..... *A45D 40/10* (2013.01)

(58) Field of Classification Search
CPC ..... A45D 40/10; A45D 2040/0018
See application file for complete search history.

(56) References Cited

U.S. PATENT DOCUMENTS 4,666,043 A * 5/1987 Tahara ..... A45D 40/20 206/581
7,429,140 B2 * 9/2008 Demellier ..... A45D 40/10 401/262

(Continued)

FOREIGN PATENT DOCUMENTS

EP 2 220 960 A1 8/2010

OTHER PUBLICATIONS

International Search Report dated Mar. 21, 2019 in PCT/EP2019/051909 filed on Jan. 25, 2019, 3 pages.

*Primary Examiner* — David P Angwin
*Assistant Examiner* — Bradley S Oliver
(74) *Attorney, Agent, or Firm* — Oblon, McClelland, Maier & Neustadt, L.L.P.

(57) ABSTRACT

The present invention relates to a device (10") for supporting a cosmetic article, of the type comprising a casing (12) that defines an internal cavity (22) and a body (14) for receiving a cosmetic article (16), the body (14) being able to be moved from a storage position in the casing to a position for extracting the body (14) from the casing, the device also comprising an intermediate member (52) that can be moved together with the body (14) between the storage position and the extraction position, the intermediate member comprising, on the one hand, a cap (72) defining a housing for receiving a portion of the body (14) and, on the other hand, a head (70) bearing at least one element of the releasable retaining assembly, the device (10") being characterized in that the cap is freely rotatable about the longitudinal axis (A-A') relative to the head of the intermediate member.

9 Claims, 3 Drawing Sheets

(56) References Cited

U.S. PATENT DOCUMENTS

| | | | | |
|---|---|---|---|---|
| 7,841,794 | B2 * | 11/2010 | Salciarini | A45D 40/10 401/262 |
| 8,353,636 | B2 * | 1/2013 | Drugeon | B65D 83/384 401/107 |
| 8,734,041 | B2 * | 5/2014 | Hermouet | A45D 33/008 401/98 |
| 10,028,568 | B2 * | 7/2018 | Lefevre | A45D 40/12 |
| 10,888,147 | B2 * | 1/2021 | Zhong | A45D 34/00 |
| 2010/0209172 | A1 | 8/2010 | Drugeon et al. | |
| 2022/0386757 | A1 * | 12/2022 | Lee | A45D 40/10 |

* cited by examiner

DEVICE FOR SUPPORTING A COSMETIC ARTICLE

The present invention relates to a device for supporting a cosmetic article, of the type comprising:

- a casing that defines an internal cavity;
- a body for receiving a cosmetic article, the body being able to be moved in a first direction along a longitudinal axis relative to the casing from a storage position of the body in the casing, in which the body is positioned at least partly in the internal cavity, to a position for extracting the body from the casing;
- a pushing member, movably mounted relative to the casing in the first direction along the longitudinal axis from a rest configuration to a configuration for moving the body to the extraction position thereof.

The expression "cosmetic product" is understood in particular to mean a product as defined in Regulation (EC) No 1223/2009 of the European Parliament and of the Council of 30 Nov. 2009 on cosmetic products.

A "cosmetic article" is understood to mean an object or a tool intended to temporarily or permanently support or receive a cosmetic product with a view to the application thereof on the skin or the keratin fibres of a human being or animal, or a self-supporting block of cosmetic product.

The device according to the present invention is intended to be used in particular for receiving and dispensing a cosmetic product packaged in the form of a block, such as a stick of lipstick, a lip care product, a foundation, a face powder, a concealer, a treatment or moisturizing composition, a hair-care product or a deodorant, with a view to the direct application thereof on the skin or the keratin fibres of a human being or animal.

A block of cosmetic product is understood to mean a mass of product that retains its shape, in particular at ambient temperature, when it is removed from its packaging device, unlike a product in more or less viscous fluid form that does not retain its shape outside of its packaging device.

As a variant, the device according to the present invention is intended to contain a receptacle that receives a liquid cosmetic product, such as a cream, a fragrance, an emulsion, the liquid product being intended to be applied by spraying onto the skin or the keratin fibres of a human being or animal.

In another variant, the device according to the invention is intended to contain a tool for applying a cosmetic product such as a cosmetic product applicator intended to be placed in contact with the cosmetic product.

In the devices for applying a cosmetic product in stick form, such as a stick of lipstick, it is known to mount the stick on a body comprising a receiving tube or "case" for this stick and a base for extracting the stick from the tube.

More specifically, the receiving tube or "case" has a tubular, generally cylindrical, general shape and has an open first end, intended for dispensing the cosmetic product in the form of a block or stick, and a second opposite end, closed by a base that houses a translational drive mechanism for a support of said cosmetic product in block form.

The first, dispensing end is referred to as the front or upper end and the second, driving end is referred to as the rear or lower end.

The body, sometimes denoted by the term "mechanism" is introduced into a casing that covers the open front end and also at least one portion of the receiving tube so as to protect the stick of cosmetic product and limit the evaporation of volatile compounds (drying) if need be when the latter is not used.

The casing is generally positioned around the receiving tube containing the stick of cosmetic product and bears against an upper shoulder of the base.

Said stick is conventionally extracted by rotating the extraction base about a longitudinal axis of the case, said rotation driving the mobile support supporting the cosmetic stick in translation along the receiving tube.

A displacement of the movable support toward the front open end causes the cosmetic product to partially emerge from the case whilst a displacement of said movable support in the opposite direction drives the retraction of the product within this same case.

Thus, after application, the block of cosmetic product may optionally be retracted within its receiving tube until the next use.

Certain devices may be equipped with means for blocking the support that only allow the displacement thereof to a dispensing of the cosmetic product and prevent the retraction of said product within the case.

Documents FR 2 853 505 and FR 2 755 592 describe examples of packaging and dispensing devices for a lipstick.

Document EP 2 381 813 describes an example of a packaging and dispensing device for a deodorant stick.

There are many drive systems for the support.

According to one particularly widespread embodiment, the base is prevented from moving translationally with respect to the case but can be moved in rotation, whilst the support can be moved in translation and is prevented from rotating with respect to this same case.

A helical groove system combined with one or more guide pins converts the rotational movement of the base into a translational movement of the support so as to bring about the deployment or the refraction of the cosmetic product with respect to the case. According to the embodiments, the guide pins may be attached to the support or to the base.

The present application is not limited to one particular drive system.

The support for the cosmetic product in block form may take, among others, the shape in particular of a cup or pot, of a latching wheel, or of a piston. This support is also referred to as a "lift" or "elevator".

In order to use the stick of cosmetic product, the user grasps the base with the fingers of a first hand, and grasps the casing with the fingers of a second hand. The user then completely extracts the body out of the casing by separating these elements.

In order to allow easy handling while maintaining an aesthetically very pleasing external appearance, the support device mentioned in the introduction additionally provides:

- an assembly for retaining the body in the storage position thereof, the retaining assembly being able to be released by moving the pushing member from the rest configuration thereof to the configuration thereof for moving the body;
- and optionally a member for elastically urging the pushing member towards the rest configuration thereof.

Such a device is known from document EP 2 220 960.

It has turned out that such a device according to document EP 2 220 960 was not able to give complete satisfaction within the context of use with a cosmetic product in stick form mounted on a body comprising a tube for receiving the stick and a base for extracting the stick from the tube.

Indeed, in the storage configuration thereof, a portion of the assembly for retaining the body in the storage position caused to move together with said body between the storage position and the extraction position engages with an outer surface of the receiving tube and immobilizes said receiving tube relative to said retaining assembly of the body in order to hold it.

In use, it has turned out that when the receiving body, in particular the base thereof enabling the entrainment of the cosmetic stick, protrudes from the casing, especially after actuating the pushing member that aims to move said body to the extraction position thereof, the users could have a tendency to rotate, intentionally or unintentionally, said base before complete separation of the body and of the casing releasing the dispensing orifice of the case.

The pushing member may also be actuated unintentionally, in particular in a bag, it being possible for various frictions to then contribute to rotating the base.

Such a rotation of the base before separation of the body and of the casing is detrimental.

Specifically, this rotation, if it takes place in the stick-emerging direction, may cause this stick to partially emerge from its case through the dispensing orifice. The casing not yet having been separated from the body, said stick of cosmetic product then risks being squashed and damaged against a wall of the casing, and in particular against a portion of the retaining assembly.

Therefore there is a need for an improved device that makes it possible to prevent the untimely actuation of the base before separation of the body and the casing. A first solution for solving this problem is to ensure a possibility of rotation directly between the retaining assembly of the body for receiving the cosmetic article and said receiving body.

In the particular case of a tube of lipstick, the retaining assembly of the body may thus have a receiving cap having a peripheral clip-fastening ribcapable of cooperating with a corresponding groove of the tube for receiving the stick. In particular, the device could be designed to engage with an inner groove of the receiving tube so as not to degrade the outer surface of the receiving tube.

However, such a system also has drawbacks in use.

Specifically, during an extraction of the receiving body, it is firstly necessary to actuate the push button then to pull on the receiving body to release the clip fastening and the retaining groove, whereas the consumer might expect an immediate release of the receiving body.

Conversely, when putting the receiving body back in place, it is firstly necessary to ensure the clip fastening of the receiving body before pushing back in the push button.

Moreover there is a risk of a clip fastening failure and of a failure to retain the receiving body.

Thus, there is a need for another system.

To achieve this, the present invention relates to a device for supporting a cosmetic article, of the type comprising:

a casing that defines an internal cavity;

a body for receiving a cosmetic article, the body being able to be moved in a first direction along a longitudinal axis relative to the casing from a storage position of the body in the casing in which the body is positioned at least partly in the internal cavity to a position for extracting the body from the casing, and in a second direction opposite to the first direction along the longitudinal axis from the extraction position to the storage position by pushing on the body;

a pushing member, movably mounted relative to the casing in the first direction along the longitudinal axis from a rest configuration to a configuration for moving the body to the extraction position thereof;

an assembly for retaining the body in the storage position thereof, the retaining assembly being able to be released by moving the pushing member from the rest configuration thereof to the configuration thereof for moving the body;

an intermediate member that can be moved together with the body between the storage position and the extraction position, the intermediate member being retained in the casing in the extraction position, the body being movable relative to the intermediate member in the extraction position to a position completely extracted from the casing, the intermediate member comprising:

a cap defining a housing for receiving a portion of the body, and a head bearing at least one element of the releasable retaining assembly, the device being characterized in that the cap is freely rotatable about the longitudinal axis relative to the head of the intermediate member.

Thus, by providing an intermediate member for receiving the body freely rotatable relative to the rest of the device and to the retaining assembly, said body may turn "idly" without activating a base for extracting the cosmetic product.

Although particularly intended for a cosmetic product packaged in the form of a stick mounted on a body comprising a receiving tube or "case" for the stick and a base for extracting the stick from the tube, the present device is not limited thereto, the possibility of having a freely rotating body also offering an ergonomic advantage for other types of bodies.

The device according to the invention may comprise one or more of the following features, considered in isolation or in any technically feasible combination(s):

the device comprises a member for elastically urging the pushing member towards the rest configuration thereof;

the pushing member is brought back to the rest position thereof by pushing on the body to the storage position thereof;

in the storage position, the body is completely contained in the internal cavity;

the device comprises a member for elastic urging of the body towards the extraction position thereof, the retaining assembly retaining the body in the storage position thereof against the member for elastic urging of the body when the pushing member occupies the rest configuration thereof;

the member for elastic urging of the body and the member for elastic urging of the pushing member are formed by a common elastic urging member, mechanically stacked between the pushing member and the body;

the member for urging of the body is different from the member for urging of the pushing member;

the portion of the body received in the cap is fixed in rotation about the longitudinal axis (A-A') relative to said cap;

the intermediate member defines a bearing wall of the member for elastic urging of the body;

the intermediate member delimits a housing for receiving the body, having a shape substantially complementary to at least one portion of the body, the intermediate member comprising releasable means for retaining the body in the intermediate member, which are positioned in the housing;

the casing extends longitudinally between an opening for operating the pushing member and an opening for extracting the body, the pushing member being operated through the operating opening in order for it to pass from the rest configuration to the pushing configuration, the body being extracted via the extraction opening on passing from its storage position to its extraction position;

the retaining assembly comprises an elastic tab firmly attached to one of either the casing or an element that can be moved together with the body, and an abutting surface of the tab delimited on the other of either the casing or the element that can be moved together with the body, the tab being applied against the abutting surface in the storage position, the movement of the pushing member from the rest configuration thereof to the configuration thereof for moving the body causing the tab to move away from the abutting surface and the element that can be moved together with the body to be released with respect to the casing;

the device comprises a cosmetic article borne by the body, the cosmetic article being chosen from a block of solid cosmetic product, a liquid and a tool for applying a cosmetic product;

the body can be moved from the extraction position thereof to a position completely extracted from the casing in which the body is completely clear of the casing;

the pushing member is movable relative to the body in the first direction along the longitudinal axis from the rest configuration to the configuration for moving the body;

the body delimits an opening for dispensing the cosmetic article, the dispensing opening being positioned in the internal cavity of the casing in the extraction position, the dispensing opening being placed outside of the casing in the completely extracted position;

in the storage position, the retaining assembly prevents the movement of the body in the first direction;

the pushing member is movable relative to the body in the first direction along the longitudinal axis (A-A') from the rest configuration to the configuration for moving the body.

According to one particular embodiment, the head is mounted freely rotatable about a corresponding pin of the cap, said pin forming an axis of rotation.

According to one particularly preferred application, the receiving body comprises a receiving tube and a base for extracting the cosmetic product from the receiving tube, the cosmetic product being in stick or block form. More particularly, the receiving body is a tube of lipstick in stick form.

The invention will be better understood from reading the following description, given solely by way of example, and with reference to the appended drawings, in which.

Figure 1:
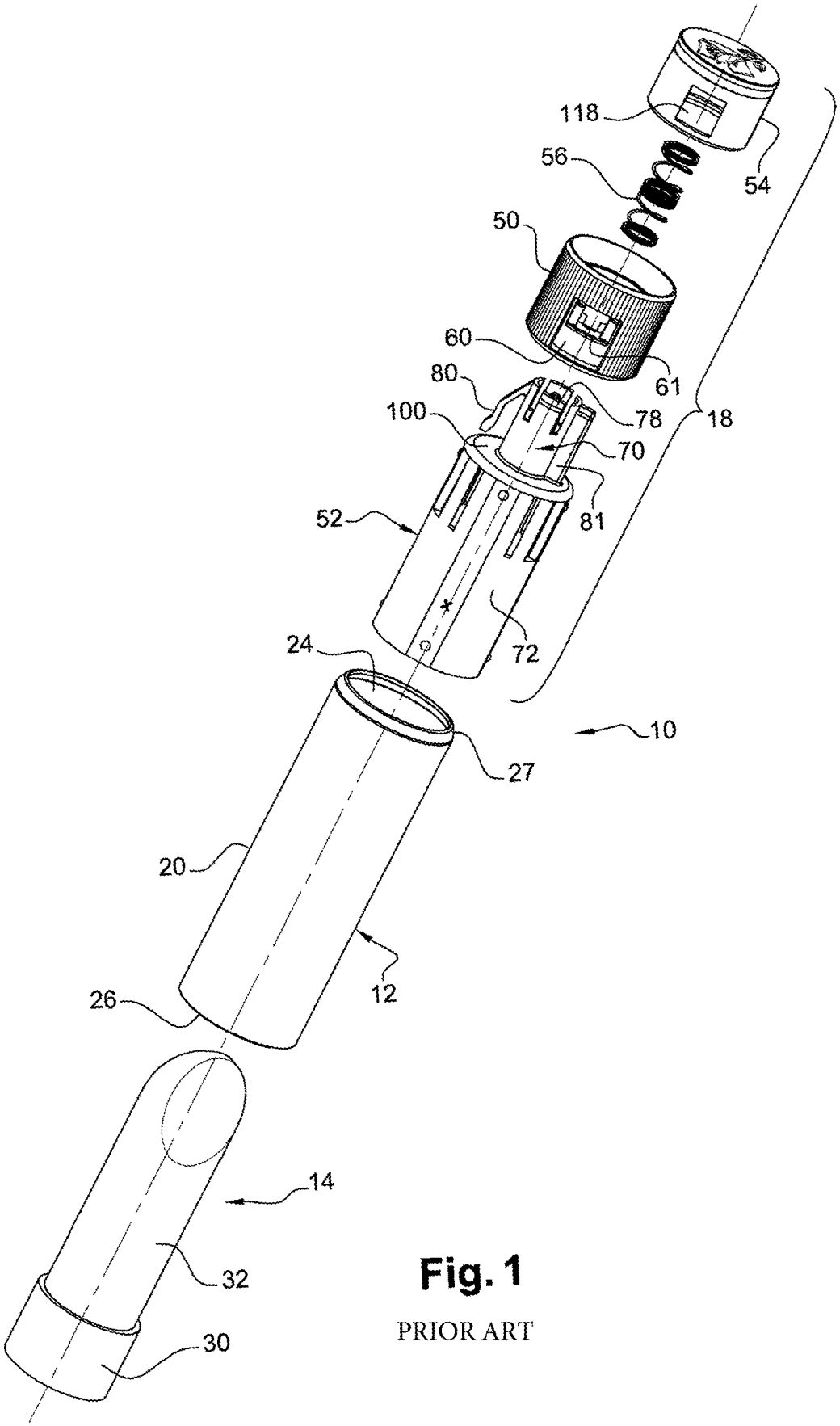
Fig. 1 PRIOR ART
FIGS. 1 and 2 are respectively an exploded view and a longitudinal cross-sectional view of a device from the prior art according to document EP 2 220 960.
Figure 2:
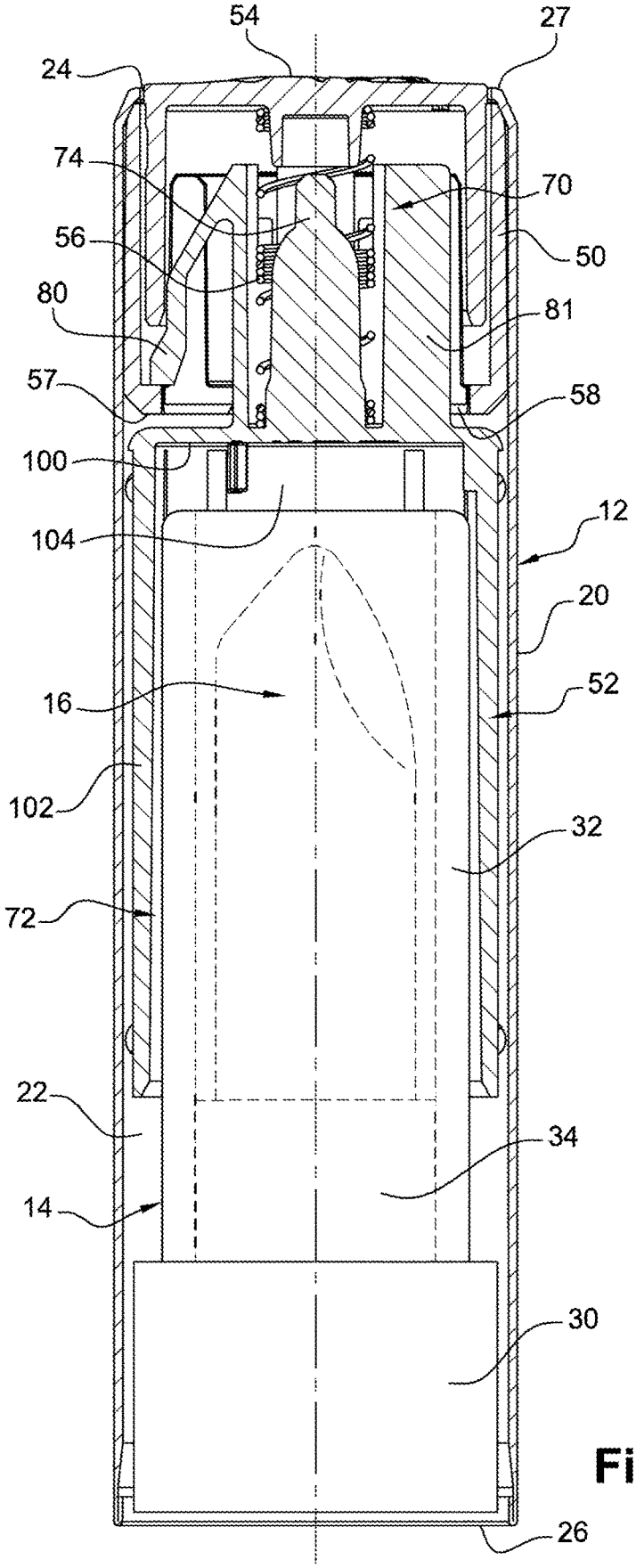
Fig. 2 PRIOR ART

An application device 10 according to the prior art EP 2 220 960 is represented in FIGS. 1 and 2.

This device 10 is intended to be used in particular for receiving and dispensing a cosmetic product packaged in the form of a block, such as a stick of lipstick, a lip care product, a foundation, a face powder, a concealer, a treatment or moisturizing composition, a hair-care product or a deodorant, with a view to the direct application thereof on the skin or the keratin fibres of a human being or animal.

The device 10 comprises an outer casing 12 visible in FIG. 1, a body 14 for receiving a cosmetic article 16 and an assembly 18 for extracting the body 14 from the casing 12.

In the example represented, the casing 12 is formed by a hollow tubular element 20 of vertical longitudinal axis A-A' in FIGS. 1 & 2.

The tubular element 20 defines an internal cavity 22 for housing the body 14 and the extraction assembly 18. The cavity 22 opens axially upwards in FIG. 2 via an opening 24 for operating the extraction assembly 18, and opens axially downwards via an opening 26 for extracting the body 14 and the cosmetic article 16.

Throughout the text which follows, the chosen orientations are indicative and are understood with respect to the figures. In particular, the terms "upper", "lower" "top", "bottom", are understood in a relative manner with respect to the chosen orientation in the figures, the terms "upper" and "top" generally being understood as closer to the operating opening 24, whereas the terms "lower" or "bottom" are understood as closer to the extraction opening 26. In practice, these orientations could be reversed.

The operating opening 24 is delimited externally by an annular rim 27 jutting out towards the axis A-A' from the tubular element 20.

The internal cavity 22 extends over the entire length of the tubular element 20. In the example represented, the cross section of the cavity 22 is circular and constant. As a variant, this cross section may have other shapes for instance a polygonal shape such as a square or triangular shape, or oval shape. The cavity 22 may have a variable cross section on moving along the axis A-A'.

In this example, the casing 12 has a substantially smooth outer surface 20 in order to improve its outer aesthetic appearance.

In the example represented, the body 14 forms a mechanism for extracting the cosmetic article 16.

Thus, the body 14 comprises a base 30, a tube 32 for receiving the cosmetic article 16 and a cup 34 that can be moved axially in the tube 32.

The base 30 has an external cross section linked to the internal cross section of the cavity 22 delimited by the casing 12 in the vicinity of the extraction opening 26.

The tube 32 protrudes axially upwards from the base 30.

The cup 34 is positioned in the tube 32. It can be moved longitudinally in the tube 32 between a retracted position, positioned in the vicinity of the base 30, and a deployed position, positioned away from the base 30.

As is known, various mechanisms exist for moving the cup 34 and the cosmetic article 16 in the tube 32 in order to extract the cosmetic article 16 from the tube 32. In one known and nonlimiting mechanism example, the base 30 is rotatably mounted with respect to the tube 32 in order to drive an assembly (not represented) for helical movement of axis A-A' of the cup 34 upwards. As a variant, a member for translational movement of the cup 34 along the axis A-A' is provided in order to be accessible by a user outside of the tube 32.

The body 14 can be moved along the axis A-A' in the casing 12 between a position for storing the body in the casing, represented in FIG. 2, and a position for extracting the body from the casing (not represented). It can furthermore be moved from its extraction position to a position extracted from the casing.

In the storage position of the body in the casing, the body 14 is substantially entirely inserted in the cavity 22. The base 30 seals the extraction opening 26 and is flush with the tubular element around this opening 26.

In the extraction position, the body has been moved away from the operating opening 24 through the extraction opening 26. The base 30 protrudes from the extraction opening 26 in order to be grasped by the fingers of a user.

In the completely extracted position, the body 14 is completely clear of the casing 12.

The cosmetic article 16 is formed by a stick 40 of cosmetic product, such as a stick of lipstick. It is securely fitted to the cup 34. The stick 40 is solid in order to have an independent mechanical strength at ambient temperature for example equal to 25° C., in the absence of any external support.

In the retracted position of the cup 34, the stick 40 is completely received in the tube 32 and does not jut out beyond this tube 32.

In the deployed position of the cup 34, the stick 40 protrudes out of the tube 32 to enable the application of cosmetic product to the skin or the keratin fibres of a user by contact between the stick 40 and the skin or the keratin fibres.

As indicated above, in the event of rotation of the base 30 before complete extraction of the body 14 from the casing 12, there is a risk of the cosmetic article becoming squashed and damaged against the inside of the device 10.

Regarding the extraction assembly 18, the latter comprises a retaining fixture 50 securely fitted to the tubular element 20 in the vicinity of the operating opening 24, an intermediate member 52 for moving the body 14 in the cavity 22, and a pushing member 54 for initiating the extraction of the body 14 from the cavity 22.

The extraction assembly 18 further comprises an urging member 56 inserted between the pushing member 54 and the intermediate member 52 for assisting the extraction of the intermediate member 52 and of the body 14 from the casing and for return of the pushing member 54, and an assembly for retaining the intermediate member 52 and the body 14.

The fixture 50 is fixedly mounted in the casing 12 bearing externally against the tubular element 20. It abuts upwards against the retaining rim 27 delimiting the operating opening 24.

The fixture 50 comprises a transverse abutting wall 57, an outer peripheral wall, and an inner peripheral wall. The peripheral walls are cylinders of axis A-A' and jut out towards the operating opening 24 from the transverse abutting wall 57.

The transverse abutting wall 57 extends substantially perpendicularly to the axis A-A'. It defines a central through-opening 58 of axis A-A' and two opposite notches (not visible) radially prolonging the opening 58 on either side of a mid-plane passing through the axis A-A'.

The outer wall delimits two opposite side apertures 60 offset angularly substantially by 90° relative to the notches about the axis A-A'. The outer wall has an external cross section smaller than the internal cross section of the cavity 22.

The inner wall delimits, opposite the side apertures 60, two U-shaped through-recesses that extend around a flexible stop 61 protruding radially towards the outer wall.

The inner wall further defines, above the notches, two axial slots for passage of the retaining element and of the indexing rib, as will be described below. Each axial slot opens axially upwards and downwards.

The transverse abutting wall 57 defines a transverse abutting surface, into which the central opening 58 and the notches 59 open. The abutting surface is oriented towards the operating opening 24.

The intermediate member 52 comprises, from bottom to top, a head 70 partially inserted in the fixture 50 and a lower cap 72 which juts out towards the extraction opening 26 from the head 70.

The head 70 comprises an inner rod 74 for guiding the urging member 56, an outer wall for supporting the retaining mechanism and stops 78 for retaining the intermediate member 52 in the casing 12. The head 70 further comprises a retaining tab 80 and a longitudinal indexing rib 81 diametrically opposite which protrude radially outwards away from the outer wall 76.

The inner rod 74 extends along the axis A-A' towards the operating opening 24 from the cap 72. It is sealed at the free end thereof.

The outer wall 76 has an external cross section which is substantially linked to the internal cross section of the central opening 58 defined in the transverse wall 57.

The retaining stops 78 extend radially away from the axis A-A' from the upper edge of the outer wall. The outer wall 76 delimits, on either side of each stop 78, two longitudinal notches which allow forced insertion of the retaining stops 78 in the fixture 50, through the central opening 58 defined in the transverse wall 57.

When the stops 78 are received in the fixture 50, they are offset angularly about the axis A-A' by around 90° relative to the notches.

In the example represented, the head 70 comprises a releasable retaining tab 80 and a longitudinal indexing rib 81 which are positioned on either side of a mid-plane passing through the axis A-A' while being offset angularly by around 90° relative to the retaining stops 78. Of course, it is also possible to have two retaining tabs 80.

More generally, the number of tabs 80 is greater than or equal to 1 and is for example between 1 and 10.

The tab 80 comprises, from bottom to top, an inner end fixed to the outer wall in the vicinity of the upper edge thereof, an intermediate portion that extends axially away from the intermediate wall and a free end that forms a retaining lug.

The lug has a bevelled outer surface suitable for cooperating with the lower edge of the pushing member 54, as will be seen below.

The cap 72 comprises an end wall 100 and a side wall 102 that internally delimit an axial housing 104 for receiving at least one portion of the body 14.

The body may be retained inside the cap by friction, especially with the aid of one or more peripheral, preferably longitudinal, ribs, located on an inner surface of the side wall 102.

The end wall 100 bears the head 70 which juts out towards the operating opening 24.

The side wall 102 juts out towards the extraction opening 26 on the opposite side from the head 70 from the end wall 100. It has an internal cross section substantially linked to the internal cross section of the casing 12 and an internal cross section substantially linked to the external cross section of the tube 32.

The length, taken along the axis A-A' of the side wall 102 is greater than the length of the head 70. This length is further less than the length of the body 14.

The housing 104 opens axially in a first direction towards the extraction opening 26. It is at least partly axially sealed in the second direction towards the operating opening 24 by the end wall 100.

The intermediate member 52 can be moved together with the body 14 between the storage position and the extraction position.

When the body 14 occupies the storage position thereof, the head 70 is substantially completely positioned in the fixture 50. The cap 72 extends relatively away from the extraction opening 76.

The tab 80 and the rib 81 are inserted into the slots made in the inner wall of the fixture 50 and the lugs thereof are applied against the upper abutting surface. The cooperation between the tabs 80 and the abutting surface prevents the movement of the intermediate member 52 and of the body 14 in the first direction.

In the extraction position, the tab 80 has been extracted from the fixture 50 through the notches.

The lugs are then located in the cavity 22 below the fixture 50 and the cap 72 is located relatively close to the extraction opening 26.

The tab 80, firmly attached to an element that can be moved together with the body 14 between the storage position and the extraction position, and the abutting surface, firmly attached to the casing, thus form the releasable assembly for retaining the body 14 in the storage position thereof.

The pushing member 54 is formed by a hollow cylindrical push button 110 partially inserted into the cavity 22 through the operating opening 24.

The button has an upper bearing wall, substantially perpendicular to the axis A-A', and a side wall which protrudes downwards from the periphery of the bearing wall, while being positioned between the inner wall and the outer wall of the fixture 50.

The side wall delimits a lower edge suitable for cooperating with the bevelled outer surface of the tab 80, as will be seen below.

The side wall of the button delimits apertures 118 that internally receive the radial stops 61 protruding from the inner wall 57B.

The button can be moved along the axis A-A' between a rest configuration, and a configuration for activating the movement of the body towards the extraction position thereof.

In the rest configuration, the button protrudes slightly outwards from the cavity 22 through the operating opening 24. As a variant, it is positioned inside the cavity 22 in the vicinity of the operating opening 24.

The lower edge is positioned above and away from the bevelled outer surface of the tab 80.

In the rest configuration, the stop 61 is applied against a lower edge of the aperture 118 in order to retain the push button.

In the configuration for activating the movement of the body, the bearing wall and the side wall have been pushed into the casing 12 in the first direction towards the extraction opening 26 in order to place them completely in the internal cavity 22.

The lower edge has moved the tab 80 radially inwards by bearing on the bevelled outer surface. It is positioned in abutment against the upper surface of the fixture 50.

In the example represented, the urging member 56 forms both a member for urging the pushing member 54 towards the rest configuration thereof and a member for urging the body 14 towards the extraction position thereof. Thus, the common urging member 56 is stacked mechanically between the bearing wall of the push button and the end wall 100 of the cap 72.

The member 56 is formed for example by a helical spring 120 positioned in the head 70 in the outer wall 76 around the rod 74.

When the body 14 and the intermediate member 52 occupy the storage position of the body in the casing, the urging member 56 keeps the tab 80 applied against the abutting surface. Moreover, the urging member 56 keeps the pushing member 54 in the rest configuration thereof, and presses the radial stops 61 against the lower edge of the apertures 118.

The operation of the device 10 according to the prior art will now be recalled. Initially, the body 14 occupies the storage position thereof in the packaging. Thus, the tube 32 is inserted in the housing 104 of the cap 72. The body 14 is then retained mechanically in the cap 72.

As was seen above, the body 14 is completely received in the internal cavity 22. The base 30 thereof is recessed in the cavity 22 relative to the operating opening 26 or is flush with the tubular element 20 at the operating opening 26.

The aesthetic appearance of the device 10 is therefore improved in the storage position, since it has a peripheral outer surface which is substantially homogeneous and in one piece.

When a user wishes to use the cosmetic product 16 contained in the body 14, he/she moves the pushing member 54 in the first direction from the rest position thereof to the configuration thereof for activating the movement of the body.

To this end, he/she presses on the bearing surface in order to counteract the urging force of the urging member 56 and moves the bearing surface towards the extraction opening 26 in the first direction along the axis A-A'.

During this movement, the side wall slides between the walls of the fixture 70 towards the extraction opening 26. The lower edge presses against the bevelled surface and brings about the radial movement of the tab 80 towards the axis A-A' by means of flexion.

The lugs move radially opposite the notches by sliding over the surface. When the lugs are completely positioned opposite the notches, the intermediate member 52 and the body 14 are axially free relative to the abutting surface.

The intermediate member 52 and the body 14 move axially along the axis A-A' in the first direction towards and through the extraction opening 26.

The spring forming the urging member 56 is deployed towards the extraction opening 26 and pushes the intermediate member 52 and the body 14 towards the extraction position, in which the base 30 of the body 14 may be grasped by the fingers of a user.

The user then releases the bearing wall 112 of the pushing member 54, which causes, under the effect of the urging member 56, the return of the pushing member 54 to the rest configuration thereof retained by the fixture 50.

In this position of the body 14, the user may completely extract the body 14 away from the casing 12 and deploy the cosmetic article 16 out of the tube 32 in order to apply cosmetic product to his/her skin and/or keratin fibres.

For this purpose, he/she may for example rotate the base 30 with respect to the tube 32 in order to move the cup 34 outwards or simply move the cup 34 by means of a specific member, as described above.

When the user has finished using the cosmetic article 16, he/she retracts it inside the tube 32, then again inserts the tube 32 into the cap 72. The body 14 is then replaced in the extraction position thereof.

The user then exerts pressure on the body 14 to move it in the second direction toward the operating opening 24 and to retract the base 30 into the casing 12 up to the storage position.

This movement of the body 14 causes the combined movement of the intermediate member 52, the compression of the urging member 56 between the bearing wall 112 and the end wall 100, then the insertion of the retaining tab 80 and of the indexing rib 81 through the notches until the tab 80 passes over the abutting surface and is deployed radially away from the axis A-A' between the abutting surface and the lower edge of the pushing member 54.

The pushing member 54 being permanently urged towards its rest configuration, the casing 12 retains a satisfactory aesthetic appearance irrespective of the position of the body 14, and in particular when the body 14 is completely extracted from the casing.

In a variant, the device 10 comprises a member for urging the pushing member 54 towards the rest position thereof, and a member for urging the body 12 towards the extraction position thereof, which is different from the member for urging the pushing member 54.

Such a device makes it possible to easily adjust the forces exerted by each of the urging members respectively on the pushing member 54 and on the assembly formed by the intermediate member 52 and the body 14.

The pushing member 54 is movable relative to the body 14 in the first direction towards the extraction opening along the longitudinal axis A-A', from the rest configuration to the configuration for moving the body.

In a first portion of the travel of the pushing member 54 between the rest configuration and the configuration for moving the body, the retaining assembly remains active for preventing the axial displacement of the body 14 and of the intermediate member 52 when it is present, from the storage position to the extraction position.

Then, in a second portion of this travel, the pushing member 54 releases the retaining assembly which allows the displacement of the body 14 and of the intermediate member 52 when it is present, in the first direction from the storage position to the extraction position.

In the device 10, the tube 32 opens via an axial dispensing opening oriented towards the operating opening 24. The tube 32 has a base oriented towards the extraction opening 26 in the storage position.

The stick 40 is extracted through the dispensing opening in the deployed position thereof.

In the device 10, the body 14 is positioned in the casing 12 so that the dispensing opening is relatively closer to the operating opening 24 and so that the base is relatively closer to the extraction opening 26.

Thus, in the extraction position, the base of the body 14 protrudes out of the cavity 22 through the extraction opening 26 in the first direction. The dispensing opening remains positioned in the cavity 22, being inaccessible for the user.

In order to access the dispensing opening, the user therefore moves the body 14 from the extraction position thereof to the completely extracted position thereof by advantageously turning it around, once extracted from the cavity 22 of the casing 12.

As was seen above, when the body 14 occupies the extraction position thereof, it can be moved in the second direction, from the extraction opening 26 to the operating opening 24, along the axis A-A' to the storage position thereof, in particular by the user pushing on the body 14.

The handling of the pushing member 54 does not enable the body 14 to return to the storage position thereof inside the internal cavity 22. This movement of the body 14 is possible without actuating the pushing member 54. The pushing member 54 is brought back to the rest configuration thereof by the pressure exerted directly on the body 14, the pushing force being transmitted by the body 14 to the pushing member 54.

The body 14 can be moved from the storage position thereof to the extraction position thereof by movement exclusively in the first direction along the axis A-A', without movement in the second direction. The body 14 can be moved from the extraction position thereof to the storage position thereof by movement exclusively in the second direction opposite to the first direction along the axis A-A', without movement in the first direction.

Figure 3:
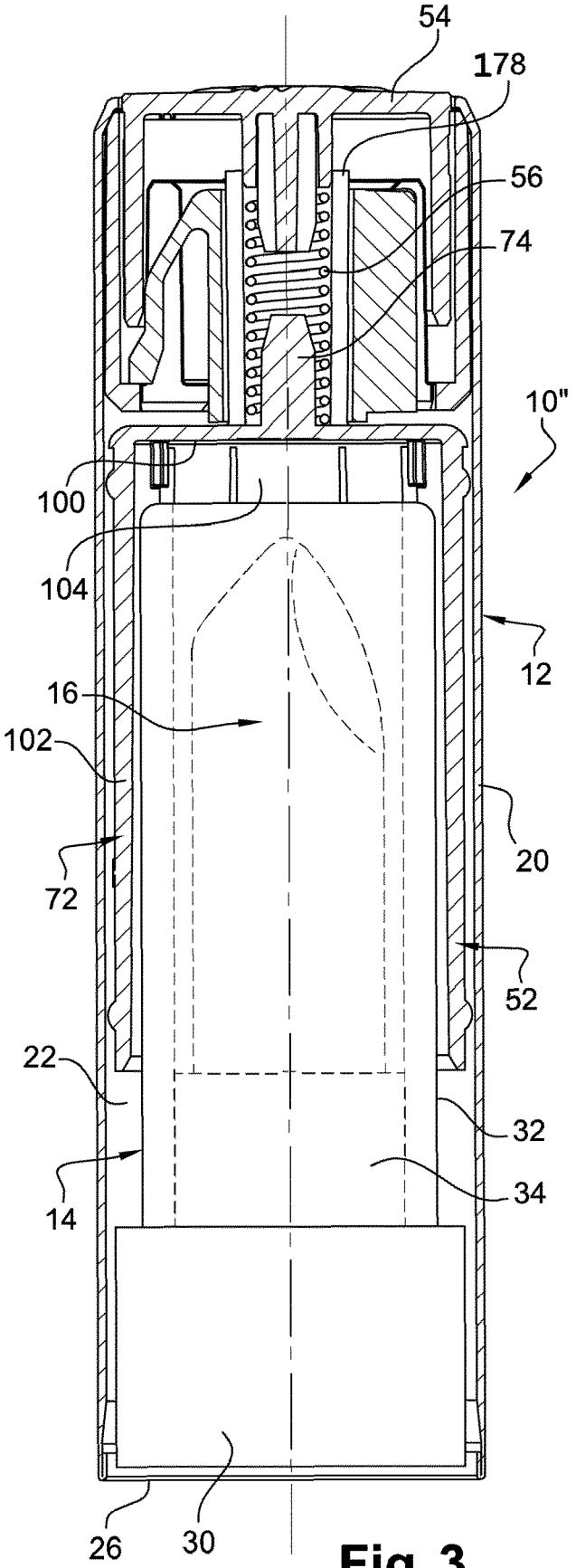
FIG. 3 is a schematic cross-sectional representation of a device according to the present application according to one particular embodiment.

FIG. 3 shows improvements of the device 10 in accordance with the present application.

More particularly, the device 10 of FIG. 3 comprises a cap 72 freely rotatable about the longitudinal axis A-A' relative to the head 70 of the intermediate member.

FIG. 3 shows one particular embodiment in which the rotatable articulation is located at the head 70, said head 70 is mounted freely rotatable about a corresponding pin 178 of the cap 72.

More specifically, the pin 178 firmly attached to the end wall 100 thus forms an axis of rotation of the head 70 or hub.

In order to do this, the head 70 bearing the tab 80 and the indexing rib 81 has a central through-orifice designed to receive the pin 178.

Longitudinal translational movement of the head is prevented with the aid of a clip-fastening system comprising an upper tranverse shoulder of the pin 178 capable of ensuring the head 70 is held between said shoulder and the end wall 100 of the cap 72.

The pin 178 forming the axis of rotation of the head 70 has a hollow cylindrical shape, located inside which is the inner rod 74 for centring the compression means 56, said compression means 56 bearing against the end wall 100 of the cap 72 between the pin 178 forming axis of rotation and the inner centring rod 74.

Thus, the cap can freely turn about the longitudinal axis of the device relative to the head. The base 30 can then be turned without causing the stick to emerge.

The invention claimed is:

1. A device for supporting a cosmetic article, of the type comprising:

a casing that defines an internal cavity;

a body for receiving a cosmetic article, the body being able to be moved in a first direction along a longitudinal axis relative to the casing from a storage position of the body in the casing in which the body is positioned at least partly in the internal cavity to a position for extracting the body from the casing, and in a second direction opposite to the first direction along the longitudinal axis from the extraction position to the storage position by pushing on the body;

a pushing member, which is movably mounted relative to the casing in the first direction along the longitudinal axis from a rest configuration to a configuration for moving the body to the extraction position thereof;

an assembly for retaining the body in the storage position thereof, the retaining assembly being able to be released by moving the pushing member from the rest configuration thereof to the configuration thereof for moving the body;

an intermediate member that can be moved together with the body between the storage position and the extraction position, the intermediate member being retained in the casing in the extraction position, the body being movable relative to the intermediate member in the extraction position to a position completely extracted from the casing, the intermediate member comprising:

a cap defining a housing for receiving a portion of the body, and a head bearing at least one element of the releasable retaining assembly, the device being characterized in that the cap is freely rotatable about the longitudinal axis relative to the head of the intermediate member.

2. The device according to claim 1, characterized in that it comprises a member for elastic urging of the pushing member towards the rest configuration thereof.

3. The device according to claim 1, characterized in that the pushing member is brought back to the rest position thereof by pushing on the body to the storage position thereof.

4. The device according to claim 1, characterized in that, in the storage position, the body is completely contained in the internal cavity.

5. The device according to claim 1, characterized in that it comprises a member for elastic urging of the body towards the extraction position thereof, the retaining assembly retaining the body in the storage position thereof against the member for elastic urging of the body when the pushing member occupies the rest configuration thereof.

6. The device according to claim 5, characterized in that the member for elastic urging of the body and the member for elastic urging of the pushing member are formed by a common elastic urging member, mechanically stacked between the pushing member and the body.

7. The device according to claim 1, characterized in that the portion of the body received in the cap is fixed in rotation about the longitudinal axis relative to said cap.

8. Device according to claim 1, characterized in that the head is mounted freely in rotation about a corresponding pin of the cap.

9. The device according to claim 1, characterized in that the receiving body comprises a receiving tube and a base for extracting the cosmetic product from the receiving tube, the cosmetic product being in stick or block form.

* * * * *